United States Patent [19]

Milden et al.

[11] 4,332,383

[45] Jun. 1, 1982

[54] BOWLING BALL WITH RETRACTABLE HANDLE

[75] Inventors: Morton Milden, West Orange; Anthony V. Falzarano, Montville, both of N.J.

[73] Assignee: Maddak, Inc., Pequannock, N.J.

[21] Appl. No.: 224,220

[22] Filed: Jan. 12, 1981

[51] Int. Cl.[3] ..... A63B 43/02

[52] U.S. Cl. ..... 273/64

[58] Field of Search ..... 273/64, 63 R, 54 B, 273/58 C

[56] References Cited

U.S. PATENT DOCUMENTS

| | | | |
|---|---|---|---|
| 1,543,743 | 6/1925 | Ballard | 273/64 X |
| 2,482,395 | 9/1949 | Zander | 273/64 X |
| 3,012,784 | 12/1961 | Barker | 273/64 |
| 4,256,305 | 3/1981 | Peterson | 273/64 |

*Primary Examiner*—George J. Marlo
*Attorney, Agent, or Firm*—Anthony F. Cuoco

[57] ABSTRACT

A bowling ball with a retractable handle is disclosed, wherein the ball (2) has a pair of substantially parallel bores (4) extending in spaced relation partially through the ball and connected by a recess (8) which receives a handle member (12) having a contour corresponding to that of the ball. Guide posts (20) slide through bushings (26) and are removably supported on the handle member. Resilient members (28) surround the guide posts and the bushings are removably supported in corresponding bores in the ball, with the guide posts and resilient members sliding into the bores. The resilient members compress when the handle member is grasped to lift the ball, and the compression is relieved upon release of the handle and ball to cause instantaneous retraction of the handle into the recess.

6 Claims, 7 Drawing Figures

BOWLING BALL WITH RETRACTABLE HANDLE

BACKGROUND OF THE INVENTION

This invention relates to a bowling ball with a retractable handle which is an improvement over like bowling balls now known in the art.

Conventional bowling balls are designed to be held by the user inserting a finger or fingers in one or more finger holes which presents a strain and inconvenience, especially for users with limited strength in their hands or with missing fingers. Bowling balls with retractable handles, whereby springs are under compression when the ball is lifted and are relieved from said compression upon release of the ball for instantaneous retraction of the handle have been designed to accomodate such users.

One such patented bowling ball includes an arrangement of components adding to the cost and complexity of the ball. For example, a U-shaped handle having a pair of legs which are threaded to receive nuts at the bottom portions thereof is taught by the patent. The nuts are pinned to the respective legs for maintaining their position thereon. Sleeves mounted above each nut partially enclose springs surrounding the legs and disposed between the nuts and plugs which are threaded in bores in the ball. This arrangement of particular components leads to a complicated ball and handle assembly which, in turn, leads to more costly equipment than may be desired.

It is therefore an object of the present invention to avoid the noted disadvantages of the prior art device by using a reduced number of components of a readily available nature and to thereby provide a simplified, less costly and improved arrangement than has heretofore been known.

SUMMARY OF THE INVENTION

This invention contemplates a bowling ball with a retractable handle, with the ball including a pair of substantially parallel, partially threaded bores extending in spaced relation partially through the ball. The bores are connected by a recess having a portion for permitting a finger or fingers to be inserted for lifting a handle which is received in the recess. The handle is a substantially arcuate shaped member adapted at each of its ends for removably receiving corresponding guide posts which slide through corresponding bushings. The bushings are removably received by corresponding bores in the ball. The guide posts have head portions and resilient members surround the posts between the bushings and head portions, with the posts and resilient members sliding into the bores.

DETAILED DESCRIPTION OF THE INVENTION

Figure 1:
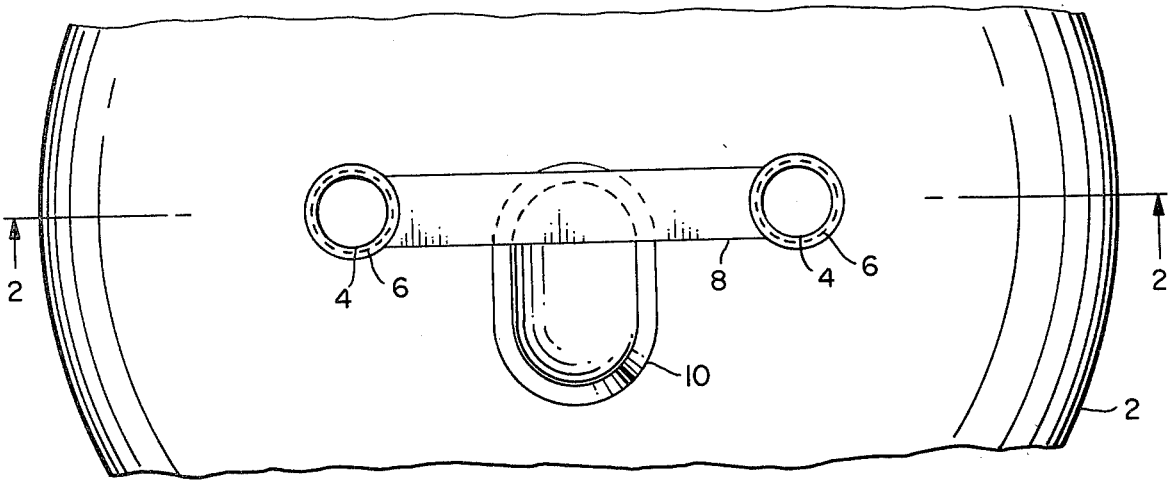
FIG. 1 is a partial top view of a bowling ball according to the invention.
Figure 2:
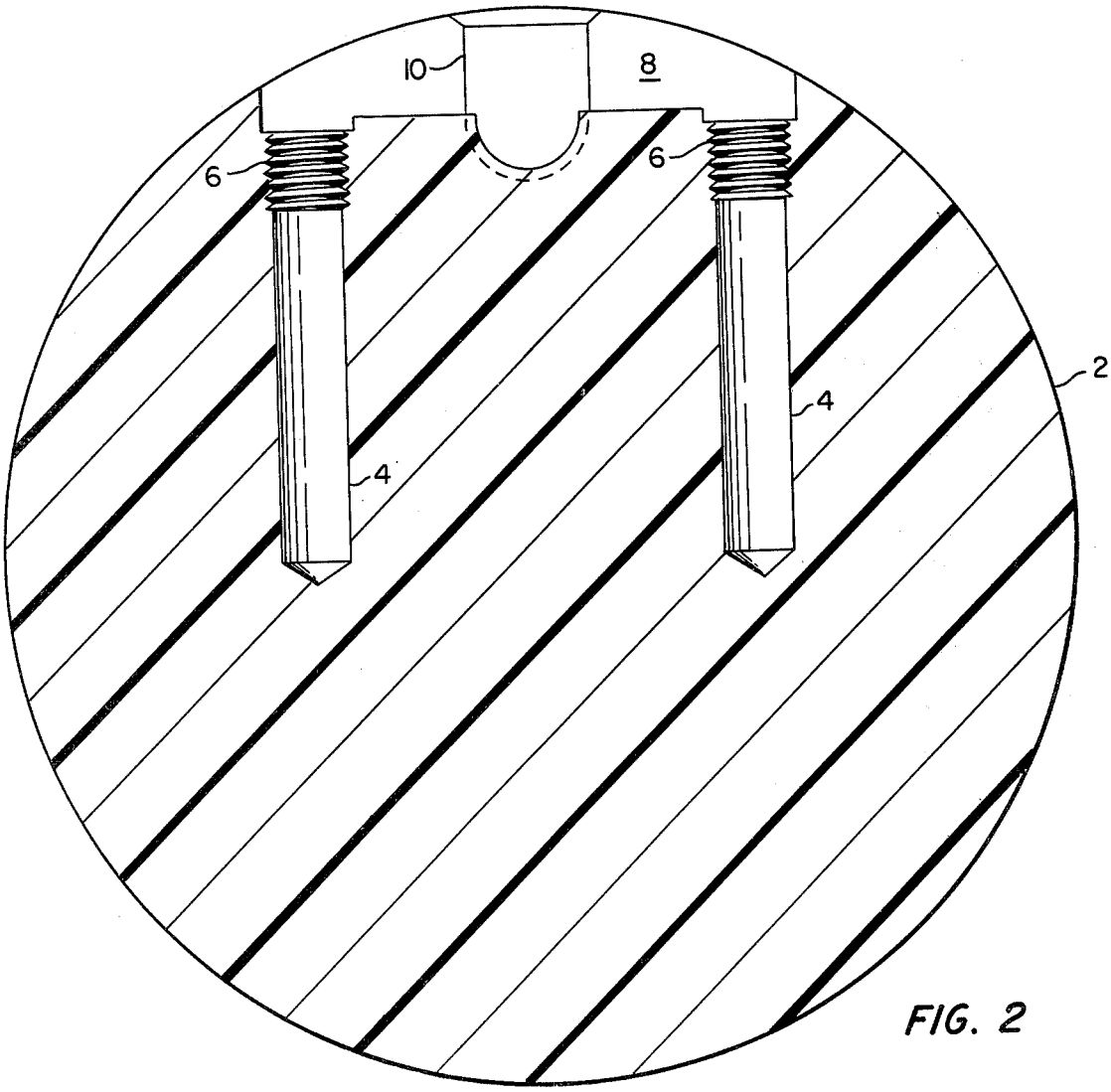
FIG. 2 is a sectional view of the bowling ball taken along line 2—2 in FIG. 1.
Figure 4:
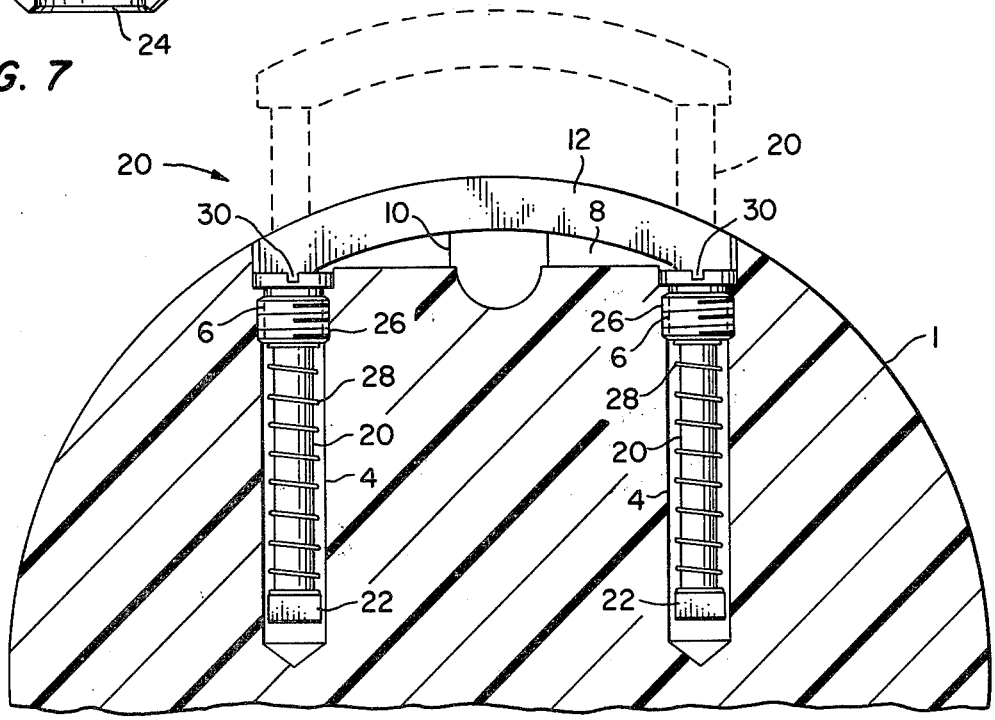
FIG. 4 is a partially sectioned assembly representation of the bowling ball and retractable handle.

Referring to FIGS. 1 and 2, a bowling ball 2 includes a pair of substantially parallel bores in spaced relation and designated by the numeral 4. Bores 4 extend partially through ball 2 and have threaded portions 6 near their open or top ends, and are connected by a recess 8 in the ball surface. Recess 8 has a widened and deepened central portion 10 to permit a finger or fingers to be inserted for lifting a handle member 12, with the lifted handle member shown in phantom in FIG. 4.

Figure 6:
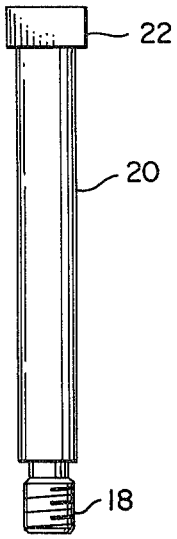
FIG. 6 is a front plan view of a guide post according to the invention.
Figure 5:
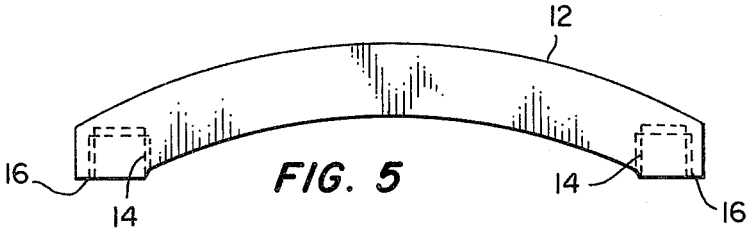
FIG. 5 is a front plan view of a handle member according to the invention.

Referring to FIG. 5, handle member 12 is a substantially arcuate member having a contour corresponding to that of ball 2 and having internally threaded holes 14 at each of its ends 16. Each of the holes 14 receives in threaded engagement a threaded end 18 of a guide post 20 so that the guide posts are removably supported on the handle member and substantially normal thereto. Guide posts 20, shown in FIG. 6, have a head portion 22 at the ends thereof opposite threaded ends 18. For the purposes described, guide posts 20 may be commercially available shoulder bolts or the like as will now be seen by those skilled in the art.

Figure 3:
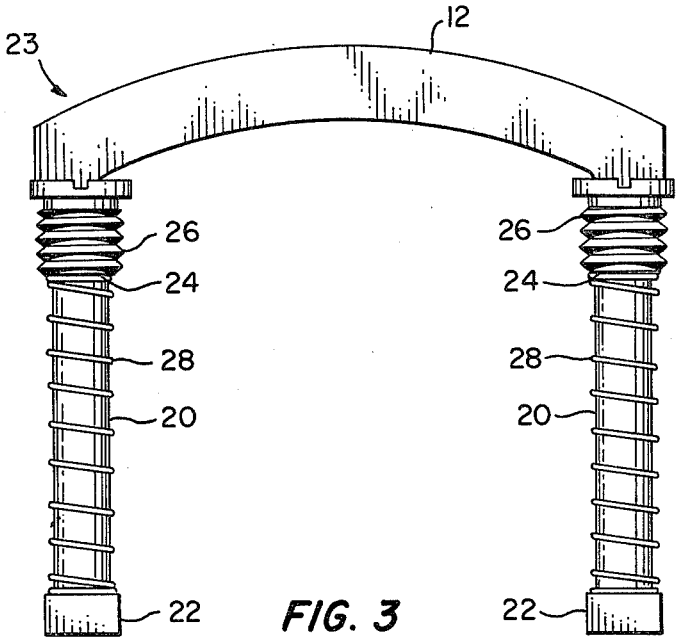
FIG. 3 is an assembly representation of the retractable handle according to the invention.
Figure 7:
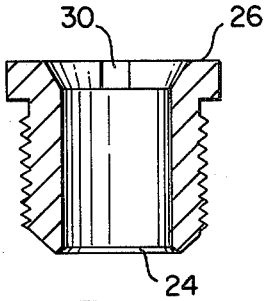
FIG. 7 is a sectioned front plan view of a bushing according to the invention.

A handle assembly is shown in FIG. 3 and is designated by the numeral 23. As shown in the Figure, guide posts 20 slide through externally threaded bushings or the like 26. Bushings 26 are shown in substantial detail in FIG. 7. Resilient members shown as commercially available coil springs 28 surround guide posts 20 between bushings 26 and guide post heads 22 so that the resilient members are captured on the guide posts.

Handle assembly 23 (FIG. 3) is mounted to ball 2 by sliding each of the guide posts 20 surrounded by springs 28 into a corresponding bore 4 until the threads of bushings 26 just engage the threads in the bores. At this time a block or the like is inserted in central portion 10 of recess 8, whereby handle member 12 is maintained in the lifted position to enable a tool to engage slots 30 of bushings 26 to thread the bushings in bores 4. In this connection it is noted that the tool may be of the spanner wrench type with appropriate clearance for guide posts 20 as will be understood by those skilled in the art. The construction of said tool is outside the scope of the present invention.

When each bushing 26 is fully threaded in its corresponding bore 4, handle 12 retracts into recess 8, with springs 28, which had been under compression, thereupon expanding to relieve said compression.

In using the bowling ball described herein, a finger or fingers is/are inserted in central portion 10 of recess 8 to grasp handle member 12 which is lifted from ball 2. As the handle member is lifted, springs 28 come under compression due to the weight of the ball. When handle member 12 is fully lifted from ball 2, the handle member is grasped by the full hand strength of the user. Upon release of the ball in an otherwise normal manner, i.e. swinging the arm in a throwing motion, springs 28 instantaneously expand, forcing handle member 12 to instantaneously retract into recess 8 before ball 2 strikes its rolling surface, i.e. the bowling alley.

In the preferred embodiment of the invention handle member 12 is of a relatively light weight metal such as aluminum, but may be of any other material suitable for ease in fabrication. The manufacturing tolerances of ball recess 8 and handle member 12 are such that when the handle member is retracted a smooth, continuous, spherical surface is provided so as not to hinder the rolling capacity of the ball.

The amount of compression that springs 28 can undergo is controlled by the distance between heads 22 of guide posts 20 and bushings 26 when the bushings are fully engaged in bores 4. Lateral distortion of springs 28 is prevented by the size relationship between bores 4, which have a uniform diameter, and the outside diameter of the springs.

A bowling ball with a retractable handle is thus described which has fewer parts, is less complex, is easier to assemble and is less costly to manufacture than like equipment now known in the art, and hence represents an improvement over the prior art equipment.

Other advantages of the invention will also be discerned from the aforegoing description. For example, if handle member 12 or guide posts 20 break, or must otherwise be replaced, the same can be easily accomplished by replacing the required component rather than the entire handle assembly as has heretofore been necessary. Also, since the ball used in combination with the invention may be of different sizes and have different spherical curvatures, handle member 12 may be easily interchanged so that the particular contour of the handle member fits that of the ball.

What is claimed is:

1. For use with a ball of the type including a pair of substantially parallel, partially threaded bores extending in spaced relation partially through the ball and connected by a recess in the ball surface having a centrally disposed widened and deepened portion, handle means for the ball, comprising:

a substantially arcuate member having a contour corresponding to that of the ball;

a pair of bushing members;

a pair of posts, each of which slides through a corresponding bushing member and terminates in a head on one of its ends;

a pair of resilient members, each of which surrounds a corresponding post between the bushing member and post head;

means associated with the ends of the posts opposite the head ends and associated with the arcuate member for removably supporting each of the posts near an end of the arcuate member substantially normal thereto;

means associated with each of the bushing members and associated with the bores for removably supporting each of the bushing members in a corresponding bore, with the corresponding posts and surrounding resilient members sliding into the bores;

the arcuate handle member being received in the connecting recess when the resilient members are extended; and a user inserting at least one finger in the widened and deepened central portion of the recess to lift the arcuate member therefrom, whereupon the ball is lifted and the resilient members are compressed by the weight of the ball.

2. Handle means as described by claim 1, wherein the means associated with the ends of the posts opposite the head ends and associated with the arcuate member for removably supporting each of the posts near an end of the arcuate member substantially normal thereto includes:

each of the posts having an externally threaded portion near its end opposite the head end;

the arcuate member having a pair of internally threaded holes, each of which is near an end of said member; and the externally threaded portions of the posts being in threaded engagement with a corresponding internally threaded hole of the arcuate member for removably supporting the posts.

3. Handle means as described by claim 1, wherein the means associated with each of the bushing members and associated with the bores for removably supporting each of the bushing members in a corresponding bore, with the corresponding posts and surrounding resilient members sliding into the bores includes:

each of the bores having an internally threaded portion;

each of the bushing members having an externally threaded portion; and each of the bushing members being in threaded engagement with a corresponding bore so that the bushing member is removably supported in the bore.

4. Handle means as described by claim 3, wherein:

the amount of compression that the resilient members can undergo is controlled by the distance between the post heads and the bushing members when said members are fully engaged with the bore portions.

5. Handle means as described by claim 1, wherein:

lateral distortion of the resilient members is controlled by the size relationship between the diameter of the bores and the corresponding size of the resilient members sliding therein.

6. A ball with a retractable handle, the combination comprising:

the ball including a pair of partially threaded, substantially parallel bores extending partially therethrough;

a recess in the ball surface connecting the bores and having a centrally disposed widened and deepened portion;

a substantially arcuate handle member having a contour corresponding to that of the ball and having internally threaded holes at each of its ends;

a pair of externally threaded bushing members;

a pair of posts, each of which terminates in a head at one end and an externally threaded portion at the opposite end, and each of the posts sliding through a corresponding bushing member;

a pair of spring members, each of which surrounds a corresponding post between the bushing member and post head;

the externally threaded portions of the posts being in threaded engagement with corresponding internally threaded holes of the arcuate member so that the posts are supported near the ends of the arcuate member substantially normal thereto;

the externally threaded bushing members being in threaded engagement with corresponding partially threaded bores, with the corresponding posts and surrounding spring members sliding into the bores;

the arcuate handle member being received in the connecting recess;

a user inserting at least one finger in the widened and deepened centrally disposed portion of the recess to lift the arcuate handle member therefrom and thereafter grasping the handle for lifting the ball, whereupon the spring members are compressed by the weight of the ball; and the compression on the spring members being relieved upon release of the handle and ball, whereupon the handle member instantaneously retracts into the recess.

* * * * *